US008579547B2

(12) United States Patent
Pollack et al.

(10) Patent No.: US 8,579,547 B2
(45) Date of Patent: Nov. 12, 2013

(54) VESSEL COMPRISING TRANSVERSE SKIRTS

(75) Inventors: Jack Pollack, Monaco (MC); Leendert Poldervaart, La Turbie (FR); Mamoun Naciri, Vallauris (FR)

(73) Assignee: Single Buoy Moorings Inc., Marly (CH)

( * ) Notice: Subject to any disclaimer, the term of this patent is extended or adjusted under 35 U.S.C. 154(b) by 934 days.

(21) Appl. No.: 10/416,490

(22) PCT Filed: Nov. 13, 2001

(86) PCT No.: PCT/EP01/13179

§ 371 (c)(1),
(2), (4) Date: Oct. 27, 2003

(87) PCT Pub. No.: WO02/38438

PCT Pub. Date: May 16, 2002

(65) Prior Publication Data

US 2004/0067109 A1 Apr. 8, 2004

(30) Foreign Application Priority Data

Nov. 13, 2000 (EP) ..... 00203969

(51) Int. Cl.
*B63B 35/44* (2006.01)

(52) U.S. Cl.
USPC ..... 405/224; 405/219

(58) Field of Classification Search
USPC ..... 114/263, 264, 230.1, 230.12, 265; 405/218, 219, 203, 205, 224; 166/355
See application file for complete search history.

(56) References Cited

U.S. PATENT DOCUMENTS

| | | | | | |
|---|---|---|---|---|---|
| 3,224,401 | A | * | 12/1965 | Kobus | 114/265 |
| 3,490,406 | A | * | 1/1970 | O'Reilly et al. | 114/265 |
| 3,500,783 | A | * | 3/1970 | Johnson, Jr. et. al. | 114/264 |
| 3,673,974 | A | * | 7/1972 | Harper | 114/265 |
| 3,788,263 | A | * | 1/1974 | McDermott et al. | 114/249 |
| 3,797,440 | A | * | 3/1974 | Pangalila | 114/125 |
| 3,921,408 | A | * | 11/1975 | Lamy | 405/31 |
| 3,978,805 | A | * | 9/1976 | Thomas | 114/264 |
| 3,983,830 | A | * | 10/1976 | Morgan | 114/77 R |
| 4,232,623 | A | * | 11/1980 | Chou et al. | 114/125 |
| 4,232,625 | A | * | 11/1980 | Goren et al. | 114/264 |
| 4,411,212 | A | * | 10/1983 | Bergman | 114/125 |
| 4,452,165 | A | * | 6/1984 | Bergman | 114/125 |
| 4,458,619 | A | * | 7/1984 | Bergman | 114/125 |
| 4,666,341 | A | * | 5/1987 | Field et al. | 405/217 |
| 4,753,185 | A | * | 6/1988 | Salusbury-Hughes | 114/61.13 |
| 4,793,738 | A | * | 12/1988 | White et al. | 405/223.1 |
| 4,848,968 | A | * | 7/1989 | Coppens | 405/204 |
| 4,966,495 | A | | 10/1990 | Goldman | |
| 4,993,348 | A | * | 2/1991 | Wald | 114/265 |

(Continued)

FOREIGN PATENT DOCUMENTS

| | | | |
|---|---|---|---|
| EP | 1 036 914 A1 | | 9/2000 |
| GB | 2009693 | * | 6/1979 |

(Continued)

*Primary Examiner* — Michael Safavi
(74) *Attorney, Agent, or Firm* — Young & Thompson

(57) ABSTRACT

A vessel having an elongated shape, and being moored to the sea bed in a substantially fixed orientation. The vessel includes at least along its longitudinal sides, near keel level, two transverse skirts having such a width that the natural roll period of the vessel is above a predetermined period, the natural roll period of the vessel without the skirts being below the predetermined period.

13 Claims, 2 Drawing Sheets

(56) References Cited

U.S. PATENT DOCUMENTS

| | | | | | |
|---|---|---|---|---|---|
| 5,190,410 | A | * | 3/1993 | Nunley | 405/196 |
| 5,330,293 | A | * | 7/1994 | White et al. | 405/211 |
| 5,527,136 | A | * | 6/1996 | Bayazitoglu et al. | 405/227 |
| 5,609,442 | A | * | 3/1997 | Horton | 405/205 |
| 5,722,797 | A | * | 3/1998 | Horton, III | 405/224 |
| 5,794,700 | A | * | 8/1998 | Pollack | 166/339 |
| 6,102,625 | A | * | 8/2000 | Olsen et al. | 405/195.1 |
| 6,125,780 | A | * | 10/2000 | Sweetman et al. | 114/264 |
| 6,206,614 | B1 | * | 3/2001 | Blevins et al. | 405/224 |
| 6,408,780 | B1 | * | 6/2002 | Ozaki et al. | 114/264 |
| 6,487,982 | B2 | * | 12/2002 | Takahashi et al. | 114/121 |
| 6,499,418 | B1 | * | 12/2002 | Pollack | 114/265 |
| 6,517,291 | B1 | * | 2/2003 | Pollack | 405/224.4 |
| 6,652,193 | B2 | * | 11/2003 | Matsuura et al. | 405/195.1 |
| 6,712,560 | B1 | * | 3/2004 | Cottrell | 405/224.4 |
| 6,718,899 | B2 | * | 4/2004 | Pollack | 114/230.1 |
| 6,761,508 | B1 | * | 7/2004 | Haun | 405/224 |
| 6,767,166 | B2 | * | 7/2004 | Matsuura et al. | 405/212 |
| 6,786,679 | B2 | * | 9/2004 | Huang et al. | 405/209 |
| 6,789,981 | B2 | * | 9/2004 | Pollack | 405/224.4 |
| 2002/0083877 | A1 | * | 7/2002 | Takahashi et al. | 114/121 |
| 2003/0103813 | A1 | * | 6/2003 | Pollack | 405/224 |

FOREIGN PATENT DOCUMENTS

| | | | |
|---|---|---|---|
| GB | 2200082 A | * | 7/1988 |
| JP | 2000-135999 | * | 5/2000 |
| JP | 2000-142569 | * | 5/2000 |
| WO | WO 99/30965 | | 6/1999 |
| WO | WO 99/50527 | * | 10/1999 |
| WO | WO 00/63519 | | 10/2000 |

* cited by examiner

VESSEL COMPRISING TRANSVERSE SKIRTS

BACKGROUND OF THE INVENTION

The invention relates to a vessel having an elongated shape, and being moored to the seabed in a substantially fixed orientation.

It is known that elongated vessels, in particular vessels having a length-to-width ratio of 1.5 or less, may be subject to roll instability or Mathieu instability. This roll instability, or parametric resonance causes roll due to heave-induced modulation of the roll hydrostatic stiffness of the system. In particular, the most severe condition would occur when the heave natural period is half the roll natural period.

SUMMARY OF THE INVENTION

It is an object of the present invention to design an elongated vessel, preferably of substantially rectangular shape, with improved stability. It is a further object of the present invention to design an elongated vessel in which roll motions are damped and in which the natural roll period is increased.

It is another object of the present invention to provide a vessel that can be built under ship construction conditions rather than under complex offshore conditions.

Hereto the vessel according to the invention comprises at least along its longitudinal sides, near keel level, two transverse skirts having such a length and width that the natural roll period of the vessel is above a predetermined period, the natural roll period of the vessel without the skirts being below said predetermined period.

It was found that the addition of skirts over the length of the elongated vessel slows the vessel in roll, in view of the added mass, such that the inertia of the vessel for roll motions is increased. Therefore, it is possible to construct the vessel such that the natural roll period is above the roll period of severe storm conditions. For example, the natural roll period of the vessel without the skirts may be about 10-18 seconds. By providing the longitudinal skirts, the natural roll period may be increased to 20-25 seconds, which is above the wave period of 15-16 seconds of a severe storm. The slower roll motions increase the comfort for personnel on the vessel and reduce fatigue in the mooring lines and production systems (for instance fewer problems with separators).

By providing the skirts of the present invention, the roll response of the vessel at wave periods can be significantly reduced, however a larger roll response is shifted to the vessel's own natural roll period.

In one embodiment, the length-to-width radio of the vessel is at least 1.5, preferably at least 2, the skirts having a width of at least 5% of the width of the vessel near keel level, and extending over at least 60% of the length of the vessel, preferably at least 90%, most preferably over at least substantially the whole length.

By providing the skirts along the majority of the length of the vessel, a large increase in roll stability, and a very favorable lengthening of the natural roll period and damping of roll motions is achieved. Preferably the skirts extend along the longitudinal and along the short sides of the vessel. Mooring lines may be attached to the skirts, and decks structures may be supported on the skirts.

It is preferred that the draft of the vessel is below 30 meters, such that it can be built on shore, under regular ship building conditions. Furthermore, it was found that vessels having a relatively low draft level, in combination with the skirts of the present invention, are very stable.

Preferably a vessel comprises a central well and at least one riser and a drill string extending from a sub sea structure through said well to a supporting structure on the vessel, such as a drilling rig. The drill string and/or riser are suspended from a pivotable support structure above the well such as a tension leg deck which is described in EP-A-1.036.914 "Method for installing a number of risers or tendons and vessel for carrying out said method" in the name of the applicant. The Tension Leg Deck (pivotable support) results in advantages such as a more stable vessel and drilling situation, so that longer drilling times are possible (less downtime). In case of liquid natural gas (LNG) production, the pivotable support structure results in less sludging and safer working conditions.

DISCUSSION OF THE PRIOR ART

It is known from WO99/44882 to provide corrugated keels along the bilge of an Floating Production Storage and Offshore Loading (FPSO) with weathervaning capacity. The bilge keels are relatively narrow and help in generating vorticity such that roll motions are damped. The natural roll period is not altered by the bilge keels.

GB 2 243 118 discloses a semi-submersible vessel of generally circular symmetry with a peripheral skirt. The semi-submersible vessel has a relatively large draft and needs to be built according to offshore construction standards.

In WO98/0439 an elongated vessel is disclosed having lips extending along the whole length of the vessel, for damping of the heave motions. Roll motions of the known vessel are avoided by aligning the vessel, which is provided with a dynamic positioning system, with the wind and wave directions. In contrast thereto, the vessel according to the present invention is moored which could be spread moored, a semi-weathervaning mooring system or a turret mooring system, and could be subject to beam waves, perpendicular to its length direction.

In Offshore Mechanics and Artic Engineering (OMAE) 1996, Volume I-Part B, Offshore Technology: Design and hydrodynamic performance analyses of a large simple barge, it is described that large skirts of a symmetrically shaped barbox (square barge) increase the heave added mass, and thereby provide a heave damping. It was observed, however that the freeboard of the skirted option was considered adequate, the roll angles observed were excessive. In contrast thereto, the roll stability of the elongated vessel of the present invention is increased by the presence of longitudinal skirts. Also the known square barge has a draft of 32 meters, such that it is unsuitable to be constructed in a regular shipyard, but must be assembled offshore.

In Norway offshore, there is a picture of Akers Maritime's Buoyform concept, as described in detail on page 114, and describing a circular cone shaped spar with skirts. Mathieu instabilities of such a buoy have caused pitch/roll motions in the order of 30-40 degrees, where motions of only 1-3 degrees were expected.

In Offshore Technology Conference (OTC) 10-953 "Alternative Shape of Spar Platforms for use in Hostile Areas", alternative hull shapes are shown in FIG. 10 on page 6. The Mathieu instability is explained and in FIG. 17 it is mentioned the unstable heave/pitch motion is so large that the deck hits the water surface.

BRIEF DESCRIPTION OF THE DRAWINGS

The invention will be explained in detail with reference to the accompanying drawing. In the drawing.

DETAILED DESCRIPTION OF THE PREFERRED EMBODIMENTS

*Fig.* 1 shows a barge 1 having a length W1 of 160 meters, the longitudinal skirts 2, 3 having a width of 15 meters each, such that the total length of the barge at the skirts, W2, is 190 meters. The height H1 of the skirts 2, 3 is 6 meters, the draft level H2 being 22 meters, the height of deck level H3 being 32 meters. The high volume of the skirts add a large inertia to the roll motion of the vessel because of the large amount of water displacement upon roll, hence providing a larger natural roll period. A volume of a skirt is at least 2% of the total volume of the barge.

Figure 1:
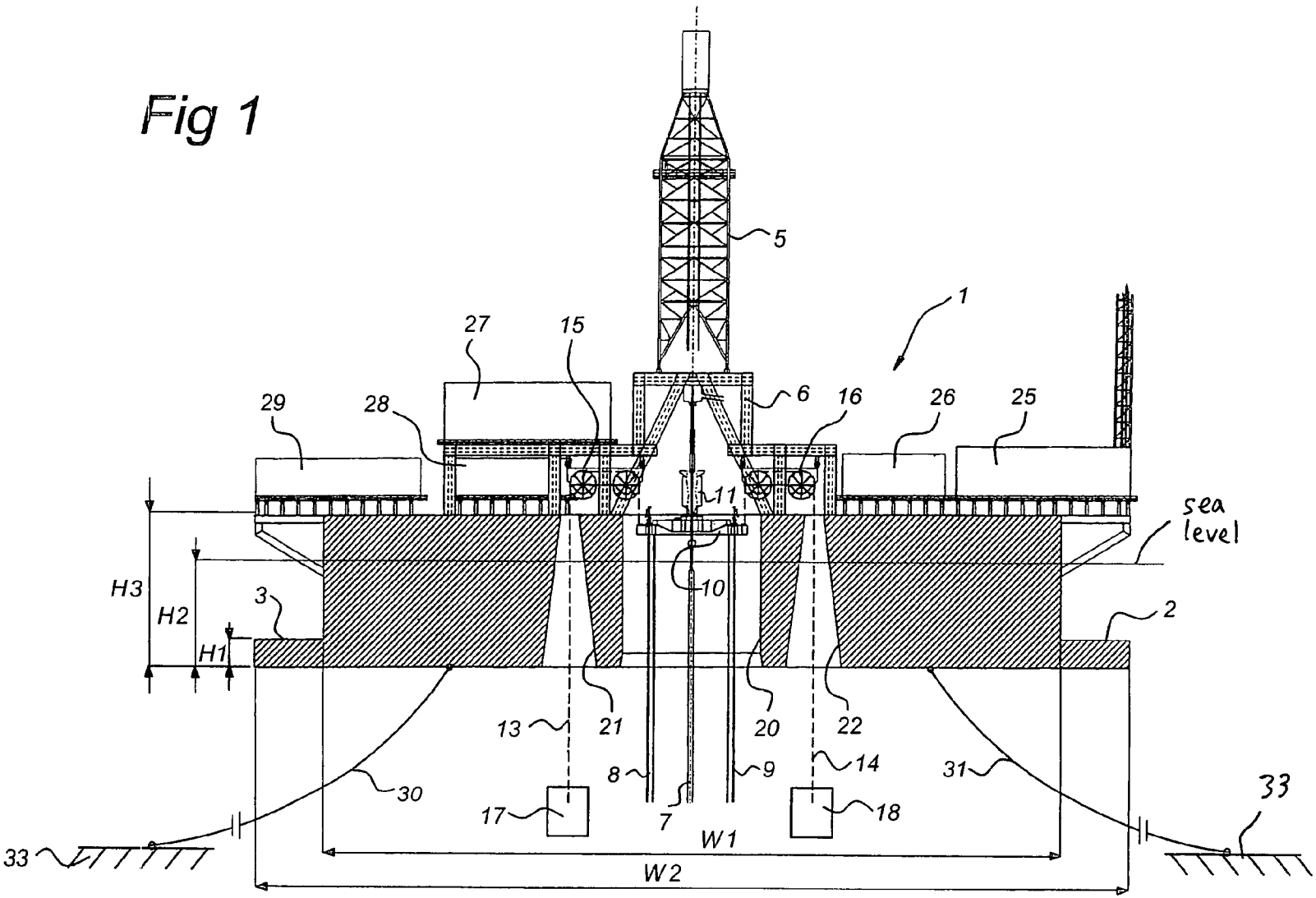
FIG. 1 shows a frontal cross-sectional view of a drilling and production barge having skirts according to the invention.
Figure 2:
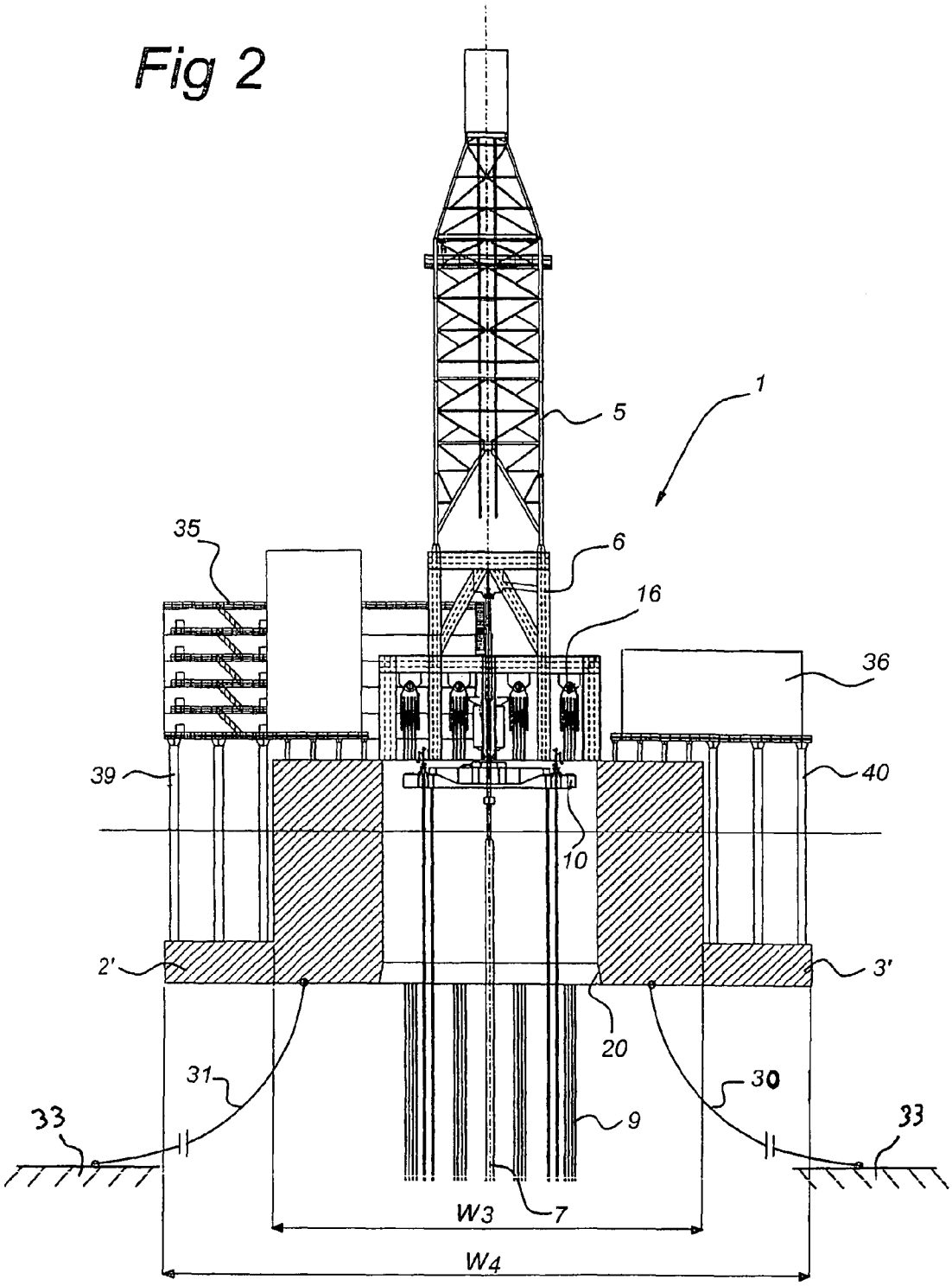
FIG. 2 shows a side cross-sectional view of a drilling and production barge having skirts according to the invention.

On the barge 1 a drilling rig 5 is placed on a rig support structure 6. From the rig 5 a drill string 7 extends towards the sea bed 33. The drill string 7 and production risers 8,9 are suspended from a deck 10. The deck 10 also supports a blow-out preventor 11. The deck is pivotably suspended from cables 13, 14, which run along sheaves 15, 16. The cables 13, 14 carry counter weights 17, 18 below water level. The drill string 7 and risers 8, 9 extend through a central well 20 in the barge 1 in which the deck 10 is suspended. The cables 13, 14 extend through tapering shafts 21, 22 through the height of the vessel 1. The vessel carries on its deck an oil separation plant 25, a gas compression plant 26, a drilling equipment compartment 27, utility space 28 and a power generator 29. Anchor lines 30, 31 moor the vessel 1 to the sea bed 33. As can be seen in FIG. 2, the skirts 2', 3', support part of the weight of deck structures such accommodation 35 or a drilling pipe and casing deck 36 via columns 39, 40 which rest on the skirts 2', 3'. In this way the skirts provide for additional deck space of the barge.

As is evident from FIG. 2, the width W3 of the barge is 60 meters, and the total width, W4, including the skirts 2', 3', is 90 meters. The skirts 2, 2', 3, 3', extend around the vessel, on all sides. The skirts are substantially horizontal.

The invention claimed is:

1. Vessel having an elongate shape, and being moored to the sea bed in a substantially fixed orientation, the vessel comprising:

skirts extending along longitudinal sides and shorts sides of said vessel, near keel level, said skirts having such a width that the natural roll period of the vessel is above a predetermined period, the natural roll period of the vessel without the skirts being below said predetermined period, said skirts are each constructed to provide a volume that displaces water, wherein the vessel is substantially rectangular in shape, the vessel comprising a central well and a drill string and/or riser extending through the well, the vessel being anchored to the sea bed in anchor points situated at a distance from the well on the hull of the vessel in a spread moored manner, wherein a length-to-width ratio of the vessel is at least 2, the skirts having over their length a substantially constant width of at least 5% of the width of the vessel near keel level, and extending over at least 60% of the length of the vessel, wherein a volume of one of said skirts is at least 2% of the total volume of the vessel, and wherein the draft of the vessel is not greater than 30 meters.

2. Vessel according to claim 1, wherein the predetermined period is at least 18 seconds.

3. Vessel according to claim 1, wherein the roll stability of the vessel with the skirts is significantly increased compared to the roll stability of the vessel without the skirts.

4. Vessel according to claim 1, the skirts being substantially horizontal.

5. Vessel according to claim 1, where the vessel is moored to the seabed with mooring lines.

6. Vessel according to claim 1, wherein a deck structure is supported by columns resting on the skirts.

7. The vessel according to claim 1, wherein the skirts extend over 90% of the length of the vessel.

8. The vessel according to claim 1, wherein the skirts extend over substantially an entire length of the vessel.

9. The vessel as claimed in claim 1, further comprising at least two risers extending through the well, said at least two risers being suspended from a supporting structure above the well, said supporting structure being pivotal with respect to a horizontal plane of the vessel.

10. Vessel having an elongated shape, and being moored to the sea bed in a substantially fixed spread moored orientation, the vessel comprising:

skirts extending along longitudinal sides and short sides of said vessel, near keel level, said skirts having such a width that the natural roll period of the vessel is above a predetermined period, the natural roll period of the vessel without the skirts being below said predetermined period;

a central well, and at least one riser and/or drill string extending through said well to a supporting structure on the vessel, the at least one riser and/or drill string being suspended from the supporting structure above the well, said supporting structure being pivotable with respect to a horizontal plane of the vessel, wherein a volume of one of said skirts is at least 2% of the total volume of the vessel and wherein the skirts are each constructed to provide a volume that displaces water.

11. A vessel comprising:

a main body having a substantially rectangular shape with a length-to-width ratio being at least two and being moored to a sea bed in a substantially fixed spread moored orientation; and a single transverse skirt along each respective longitudinal side and along each respective short side of said main body, near keel level, said skirt having such a width that a natural roll period of the vessel is above a predetermined period, the natural roll period of the vessel without the skirts being below said predetermined period, the vessel comprising a central well, wherein the volume of one of said skirts is least 2% of a total volume of the main body, and wherein each said skirt is constructed to provide a volume that displaces water.

12. The vessel according to claim 11, wherein the predetermined period is at least 18 seconds.

13. The vessel according to claim 11, wherein a draft of the vessel is not greater than 30 meters.

* * * * *

UNITED STATES PATENT AND TRADEMARK OFFICE

CERTIFICATE OF CORRECTION

PATENT NO. : 8,579,547 B2
APPLICATION NO. : 10/416490
DATED : November 12, 2013
INVENTOR(S) : Pollack et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 10 days.

Signed and Sealed this
Twenty-second Day of September, 2015

Michelle K. Lee

Michelle K. Lee
*Director of the United States Patent and Trademark Office*